US006371589B1

(12) United States Patent
Conta et al.

(10) Patent No.: US 6,371,589 B1
(45) Date of Patent: Apr. 16, 2002

(54) DEVICE FOR CONTROLLING ENERGY SUPPLIED TO AN EMISSION RESISTOR OF A THERMAL INK JET PRINTHEAD

(75) Inventors: Renato Conta, Ivrea; Angelo Menegatti, Banchette, both of (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 09/402,985

(22) PCT Filed: Apr. 2, 1998

(86) PCT No.: PCT/IT98/00075

§ 371 Date: Oct. 14, 1999

§ 102(e) Date: Oct. 14, 1999

(87) PCT Pub. No.: WO98/46430

PCT Pub. Date: Oct. 22, 1998

(30) Foreign Application Priority Data

Apr. 16, 1997 (IT) ..... TO97A0321

(51) Int. Cl.[7] ..... B41J 29/38; B41J 2/05; B41J 2/045

(52) U.S. Cl. ..... 347/14; 347/59; 347/67

(58) Field of Search ..... 347/14, 17, 62, 347/59, 58, 67, 19

(56) References Cited

U.S. PATENT DOCUMENTS 4,514,741 A * 4/1985 Meyer ..... 338/126
4,590,362 A * 5/1986 Ishima ..... 347/17 X
5,036,337 A * 7/1991 Rezanka ..... 347/17 X
5,122,812 A * 6/1992 Hess et al. ..... 347/9 X
5,210,549 A * 5/1993 Takahashi ..... 29/890.1 X
5,418,558 A * 5/1995 Hock et al. ..... 347/14
5,521,620 A 5/1996 Becerra et al.
5,706,041 A * 1/1998 Kubby ..... 347/65
5,943,069 A * 8/1999 Kamiyama et al. ..... 347/14

FOREIGN PATENT DOCUMENTS

EP 0475235 a 3/1992
EP 0650838 A 5/1995
EP 0752313 A 1/1997

* cited by examiner

*Primary Examiner*—David F. Yockey
(74) *Attorney, Agent, or Firm*—Banner & Witcoff, Ltd.

(57) ABSTRACT

In a thermal ink jet printhead, an emission resistor includes a layer of electrically conductive material for making connections to the resistor. A temperature sensor and a reference temperature sensor, provided for detecting the temperature of enucleation of a bubble and used to directly determine the amount of energy needed for the emission resistor to effectively reach the temperature of enucleation, are arranged in correspondence with an integrated test resistor identical in construction to the emission resistor. The temperature sensor is formed from the layer of electrically conductive material. A differential amplifier having inputs connected to the temperature sensor and the reference temperature sensor effects regulation of a variable duration of pulses applied to the emission resistor.

12 Claims, 3 Drawing Sheets

VOL
30
$E_S$
$E_g$
$E_l$
E

In
70
t
Out
$V_{REF}$
71
t
Out
72
t 40
41
42
43
44
45
46
47
48
49
50
51
52
53
54
55
56
57
58
59
60
62
63
A
C
T
+
−
$R_1$
$R_T$
$R_2$
$R_3$
$RS_1$
$RS_2$
$V_{REF}$
V+
In

DEVICE FOR CONTROLLING ENERGY SUPPLIED TO AN EMISSION RESISTOR OF A THERMAL INK JET PRINTHEAD

BACKGROUND OF THE INVENTION

1. Field of the Invention

The invention relates to a printhead used in equipment for producing black and colour images on a printing medium, generally though not exclusively a sheet of paper, using the thermal ink jet technology, and to a device and associated method of operation for regulating the energy supplied to the emission resistors of the head.

2. Related Technological Art

Equipment of the type described above is known in the art, such as for example printers, photocopying machines, facsimile machines, etc., and particularly printers used for the printing of a document, by way of printing means generally taking the form of fixed or interchangeable printheads.

The composition and general method of operation of a thermal ink jet printer, as also those of the relative ink jet printhead, are already widely known in the art and will not therefore be described in detail here, a more detailed description being provided only of some of the characteristics of the heads that help give a better understanding of the present invention.

A typical ink jet printer schematically consists of:

- a system, selectively activated by a motor, for supplying and feeding the sheet of paper whereon the image is to be printed, in such a way that the feeding is performed in a determined direction in discrete steps (line feed),
- a movable carriage, sliding on ways in a direction perpendicular to that of the sheet feeding, selectively activated by a motor to perform a forward motion and a backward motion over the entire width of the sheet,
- printing means, generally for example a printhead, removably attached to the carriage, comprising a plurality of emission resistors deposited on a substrate (usually a silicon wafer), and disposed inside emission cells or chambers filled with ink, each individually connected to a corresponding plurality of nozzles, through which the head can emit droplets of ink, and to a main tank containing the ink,
- an electronic controller which, on the basis of the information received from a computer whereto it is connected and of the presetings made by the user, selectively commands the above-mentioned motors and also the printhead, resulting in the emission therein, by way of the selective heating of the resistors, of the droplets of ink against the surface of the sheet, thus generating a visible image.

According to a recent evolution of the known art, the printheads also comprise, in addition to the emission resistors, the active driving components that selectively supply the energy for heating the emission resistors, generally in the form of MOS transistors integrated within the semiconductor substrate, i.e. produced using known techniques of the silicon wafer integrated semiconductor circuit technology.

From the electrical point of view, these integrated driving components, as they all have substantially identical geometrical and electrical properties, and their associated emission resistors, are typically laid out according to working arrangements known in the sector art in a matrix of rows and columns, so as to minimize the number of connections and contacts between the head and the electronic controller.

The energy is supplied by the MOS transistors to the emission resistors, selectively enabling a current supplied by a voltage power supply unit to flow through the said resistors, all the emission resistors being connected to this power supply unit. Inside the emission resistor, this current is transformed into thermal energy by the Joule effect, resulting in its heating rapidly to a temperature of more than 300° C. A first portion of this thermal energy is transferred to the ink present in the emission chamber surrounding the resistor, vaporizing it with the resultant enucleation of a vapour bubble and thus causing the expulsion of a droplet of given volume through the nozzle connected to that emission chamber. A second portion of this thermal energy is lost by conduction through the common substrate (the silicon wafer) whereupon are deposited the emission resistors, increasing the temperature $T_s$ of the substrate and thus of the head as a whole and of the ink contained therein, with respect to the ambient temperature.

The phenomenon of droplet emission may be better understood with reference to the graph in FIG. 1, illustrating the experimentally proven trend represented by the curve 30 of the volume VOL of the droplet of ink emitted by a nozzle, in relation to the thermal energy E supplied to the emission resistor in the cell connected to the nozzle, for a given constant value of the temperature $T_s$ of the substrate.

As shown by the graph, below a value $E_s$ (threshold energy) the droplet is not formed, since the resistor does not reach a high enough temperature to vaporize the ink surrounding it. If the energy E supplied to the resistor is increased from value $E_s$ to value $E_g$ (knee energy), the volume VOL of the droplets emitted increases substantially proportionally to the increase in energy E supplied to the emission resistor; beyond the value $E_g$, the volume VOL on the other hand remains substantially unchanged with the increase in the energy E supplied to the resistor. This zone is the zone normally used as the working zone.

The knee energy $E_g$ of a thermal ink jet head is a characteristic of the geometrical and manufacturing configuration adopted, apart from being also dependent on the working temperature $T_S$ of the substrate (Si wafer), as seen above. With all other conditions being equal, it varies from head to head as a result of deviations entering the manufacturing processes. In particular, for the heads with integrated driving components, it depends largely on the following parameters typical of the manufacturing process:

- thickness of the field oxide $SiO_2$ (Locos—local oxidation of the Silicon substrate),
- thickness of the protective passivation (BPSG—Boron/Phosphorous silicon glassivation),
- thickness of the SiN and SiC protective layers on the emission resistors,
- thickness of the Ta anti-cavitation layer,
- resistance value and geometrical dimensions of the emission resistors,
- the RON value of the integrated MOS active drive components.

Use is made of the asymptotic characteristic of the pattern of the volume VOL of the droplets in relation to the energy E supplied to the emission resistor in defining the typical working value $E_I$ for the energy E to be supplied to the emission resistor (energy operating point). In current practice, for example, a value is taken for $E_I$ that is considerably higher than $E_g$, so that any limited fluctuations of the thermal energy E supplied to the emission resistor (for various reasons, for example the natural tolerances of the power supply voltage value and of the duration of the current pulse supplied to the emission resistors by the printer the head is fitted on) or deviations of the value $E_g$ due to the tolerances of the head manufacturing parameters, do not entail significant variations of the volume VOL of the droplets emitted.

This is due to the fact that the energy operating point of the emission resistors is in any case inside the asymptotic portion of the curve 30, thereby avoiding the occurrence of unstable operating conditions, which could on the other hand occur if $E_I$ were to drop below $E_g$ and the droplet volume were to become variable.

However, use of a value of $E_I$ that is considerably higher than $E_g$ also involves a series of negative effects, on account of the rise in temperature of the head due to the portion of thermal energy that is not used for emission of the droplet of ink. Among these negative effects are:

- the volume of the droplets of ink emitted by the nozzles, for a like working energy value $E_I$, increases with the rise in temperature of the substrate (and therefore of the ink) causing, as illustrated above, a corresponding variation of the diameter of the elementary dots printed on the paper and uniformity of the printout deteriorates accordingly. The phenomenon may be so marked that the characters printed at the top of a page may differ significantly in optical density from those printed at the bottom, due to the rise in head temperature caused in printing the page;
- furthermore, the reaching of very high head temperature levels on certain specific emission resistors activated frequently during printing may lead to a phenomenon of deposition of carbon residues following decomposition of the ink on the resistor, dramatically reducing the working lifetime of the resistor and causing operating anomalies of the printhead due to failure of the relevant nozzle to emit ink.

To combat these negative effects at least in part, methods and devices have been proposed in the known art with the essential objective of stabilizing the temperature $T_s$ of the substrate, in other words of having the head work at a substantially constant substrate temperature $T_s$.

For example, one suggestion was to reduce the printing speed (and thereby to reduce the droplet emission frequency) when the temperature $T_s$ tends to exceed a defined limit, in order to increase the time allowed the head to cool naturally and stabilize at a lower temperature. Another was to interrupt printing when the substrate temperature exceeds a predetermined level. These solutions are, however, unsatisfactory because they are detrimental to the work speed or throughput, a requirement that is constantly more and more appreciated among users of ink jet printers.

Systems have also been suggested for maintaining the substrate temperature $T_s$ constant, by making the head work permanently at an established maximum temperature level using, for example, either supplementary resistors in addition to the emission resistors to heat the head, if and as necessary; or by using the emission resistors themselves to heat the head. In this case, the emission resistors of the nozzles not required to emit droplets of ink are still heated, but with energy pulses of too high a frequency to produce droplet emission. Both these solutions, however, require that the head be fitted with a temperature sensor, in the form of a thermistor, for instance, fitted in contact with the head, duly making the head more complex and more costly to build. Nor are these solutions entirely satisfactory because they fail to solve the problem of the carbon deposits on the emission resistors, since stabilization of the temperature takes place at high levels.

Accordingly it is preferred to adopt a different strategy, consisting in controlling the working energy $E_I$ supplied to the emission resistors, so as to supply each head fitted on the printer an energy that is only slightly greater than the effective energy $E_g$ characteristic of that specific head; since however, as already seen, the value of $E_g$ varies from head to head, this value must be known beforehand or, alternatively, the printer employed must dispose of means for measuring a characteristic of the emission resistor of the head, used as the basis for definition of the correct driving conditions for the head fitted on that printer.

One example of a solution is that described in the European Patent Application EP 626266 for a head comprising a "dummy" emission resistor, i.e. one not used for generating droplets of ink, but having exactly the same characteristics, resistance in particular, as the emission resistors, being manufactured in the same process and with the same parameters as the emission resistors. Depending on the value of this dummy resistor as measured at the end of the head manufacturing process, the heads are divided into classes corresponding to established resistance ranges, each head then being given a code in relation to its class and the code being recognized by the printer the head is fitted on, for correct adaptation of the current supplied to the emission resistor.

This system, however, apart from the fact that its precision decreases the wider the interval assigned to each subdivision of the head resistance variability range, does not make any allowance for other manufacturing factors that also contribute to differentiating between heads which may have resistance values in the same class, such as for example, thickness of the insulating layer separating the resistor from the ink, nor does it make any allowance for different power supply voltages of the various printers that a head may be fitted on.

The latter problem has been solved, for example, by the U.S. Pat. No. 5,083,137 in which the power supply voltage of the emission resistors provided by the printer is variable, and can be regulated by way of a counter-feedback circuit in relation to the signal provided by comparing means that compare the voltage actually supplied to the emission resistors with a predetermined rekerence value.

The European Patent Application EP 752313 A discloses a solution in which the temperature of the substrate of the printhead is maintained constant by means of a feedback circuit that regulates the power to be dissipated by an additional resistor.

However, it will be clear that, even if the teachings of all the previously known solutions are applied simultaneously, the problem would still not be fully resolved of supplying each head a working energy $E_I$ only slightly greater than the knee energy $E_g$ characteristic of that specific head.

SUMMARY OF THE INVENTION

The object of this invention is to define a device for controlling the energy supplied to an emission resistor of a thermal ink jet printhead fitted on a printer, said emission resistor being capable of generating a vapour bubble upon reaching an enucleation temperature, and said printer comprising means for supplying a variable amount of said energy to said emission resistor, characterized in that it comprises means integrated on said head for detecting said enucleation temperature, and means for regulating said variable amount of said energy supplied to said emission resistor, so that said emission resistor reaches said enucleation temperature, dependent on said means for detecting said enucleation temperature.

In this way, compensation is provided for all the variables and deviations of the printhead manufacturing process, and for the different driving characteristics of the various printers that the head can be fitted on.

Another object of the invention is to define a method for controlling the energy supplied to an emission resistor of a thermal ink jet printhead fitted on a printer, said emission resistor being capable of generating a vapour bubble upon. reaching an enucleation temperature, and said printer comprising means for supplying a variable amount of said energy to said emission resistor, characterized in that it comprises the following steps: having means integrated on said head for detecting said enucleation temperature; regulating said variable amount of said energy supplied to said emission resistor, so that said emission resistor reaches said enucleation temperature, dependent on said means for detecting said enucleation temperature.

Another object of the invention is to define a method for controlling the energy supplied to an emission resistor of a thermal ink jet printhead fitted on a printer, said emission resistor being capable of generating a vapour bubble upon reaching an enucleation temperature, and said printer comprising means for supplying a variable amount of said energy to said emission resistor, characterized in that it comprises the following steps: having means integrated on said head for detecting a variation of the positive temperature coefficient of the resistance upon reaching said enucleation temperature; regulating said variable amount of said energy supplied to said emission resistor, so that said emission resistor reaches said enucleation temperature, dependent on said means for detecting said variation of the positive temperature coefficient of the resistance.

A further object of the invention is to define a thermal ink jet printhead comprising means for supplying a variable amount of energy to an emission resistor capable of generating a vapour bubble upon reaching an enucleation temperature, characterized in that it further comprises means for detecting said enucleation temperature comprising a first resistor obtained from a layer of electrically conductive material in correspondence with a test resistor, identical in construction to said emission resistor.

Yet another object of the invention is to define an ink jet printer comprising a thermal printhead comprising means for supplying a variable amount of energy to an emission resistor capable of generating a vapour bubble upon reaching an enucleation temperature, characterized in that said printhead further comprises means for detecting said enucleation temperature comprising a first resistor obtained from a layer of electrically conductive material in correspondence with a test resistor identical in construction to said emission resistor.

The above objects are fulfilled by a device for controlling the energy supplied to an emission resistor of a thermal ink jet printhead, the associated method of operation, the associated printhead and associated printer, characterized as defined in the main claims.

A clearer understanding of these and other objects, characteristics and advantages of the invention will be gained from the following description of a preferred embodiment, provided purely by way of an illustrative, non-restrictive example, with reference to the accompanying drawings.

LIST OF FIGURES

DESCRIPTION OF THE PREFERRED EMBODIMENT

Figure 2:
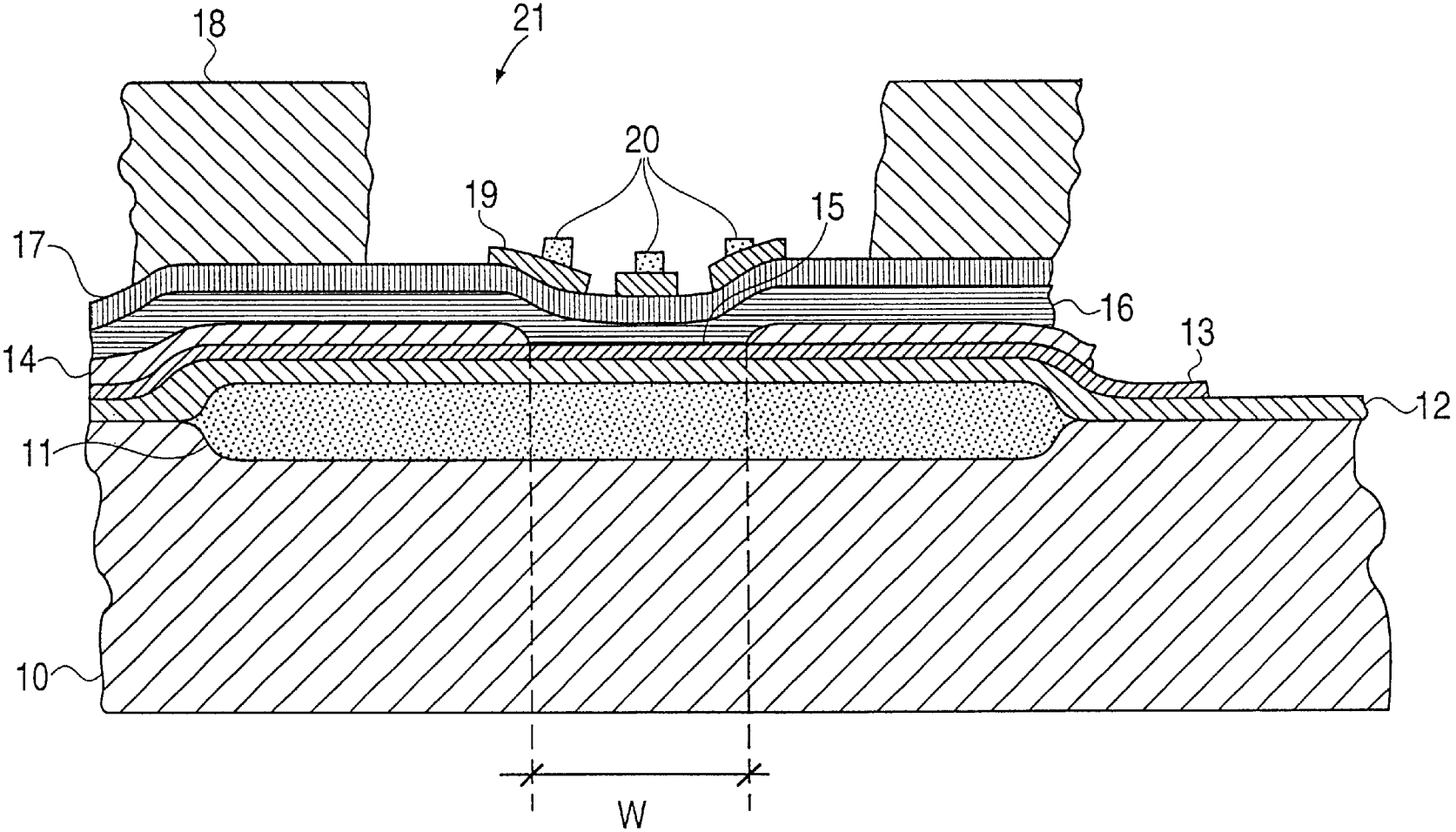
FIG. 2 is a simplified, partial, lateral, cross-sectional view of an integrated thermal ink jet printhead according to the invention.

Shown in FIG. 2 is a simplified, partial, lateral, cross-sectional view of an integrated thermal ink jet printhead built according to the known CMOS/LDMOS technique in a preferred embodiment of the device according to the invention. Using methods known in the sector art, a local oxidation (Locos) is produced on a monocrystalline Silicon substrate 10 to generate a first insulating layer of $SiO_2$11. A passivating layer is subsequently produced by creating a film of boron/phosphate siliceous glass BPSG 12, upon which is deposited a resistive film of Ta/Al 13 partially masked by a conductive film of Al/Cu 14. The unmasked area 15 of the Ta/Al resistive film of width W constitutes an emission resistor, whereas the linking conductors are obtained from the Al/Cu conductive film 14. The emission resistor 15 is protected against corrosion and oxidation due to the ink by a first protective layer of SiN 16 and by a second protective layer of SiC 17, whereas a polymer layer 18 laterally delimits an emission cell or chamber 21 containing ink and in communication with a main ink tank not shown in the figure. The emission chamber 21 is delimited to the top by a nozzle bearing plate (not shown in the figure) wherein are produced the nozzles through which the droplets of ink are expelled. A printhead possesses a plurality (hundreds in some cases) of emission chambers 21 and corresponding nozzles. Inside the head comprising the device of the invention, a temperature sensor $RS_1$41 has been made in one of these emission chambers, which is accordingly not intended for generating printing dots, in correspondence with the emission resistor 15, which in this case assumes the function of "test" resistor $R_T$43 (see FIG. 3). The sensor $RS_1$41, deposited on a layer of Ta 19, is made of a film of Au 20 and is given a zig-zag or spiral shape using a known type photolithographic technique.

The Au film is normally used in integrated heads as a second level of interconnection, not therefore requiring any additional processing step, and represents the most superficial layer. Typically it is 2000÷4000 Å thick, preferably 2500÷3000 Å, with resistivity of ~130 mΩ/□ and a temperature coefficient of resistance TCR≅4000 ppm/° C. The reasons behind the choice to use an Au film as the temperature sensor $RS_1$ are as follows:

- the photolithography technique can be used to produce a zig-zag or spiral shape of the Au film of between 2 and 10 μm wide, preferably ≦5 μm, with optimum definition,
- though its resistivity is somewhat low, Au has quite a high and easily reproducible TCR, which is not affected by the crystallographic structure of the film (deposition parameters),
- being chemically inert, it does not oxidize or corrode in presence of air or ink even at the temperatures reached by the emission resistor (~320° C.).

In addition to the temperature sensor $RS_1$, also built in the head according to the invention is a reference temperature sensor $RS_2$42 (FIG. 3), identical in all characteristics to the temperature sensor $RS_1$41, located on the substrate 10 not in correspondence with an emission resistor 15 but placed instead at a certain distance, a few hundred $\mu$m for example, away from the temperature sensor $RS_1$41. As will be seen later, its purpose is to compensate for all the deviations and tolerances of the integrated head manufacturing process, which would make the absolute value of $RS_1$ too variable to be suitable for effective use in measuring the temperature reached by the "test" resistor.

Typically the dimensions of the "test" resistor $R_T$43 (like the emission resistors 15) are 50×50 $\mu$m, which enables sensors $RS_1$41 and $RS_2$42 to be made having a resistance of 3÷6 Ω, preferably 4.5÷5 Ω, which in turn grants a $\Delta R \cong 5.5$ Ω for a $\Delta T = 300°$ C., thereby providing a signal of 10÷11 mV with a polarization current of 2 mA. This signal would however be too low to be able to be used directly by the electronic controller of the printer whereon the printhead is fitted; the CMOS/LDMOS technology employed in manufacturing the head advantageously enables fabrication, without adding process steps or "masks", of all the electronic components (for example, bipolar NPN transistors with $\beta = 30 \div 40$, resistors in the 10 Ω÷100 kΩ range of values, polarization or temperature-compensated diodes in the emitter/base-collector short circuited configuration) needed to build an integrated differential amplifier on the head, well compensated electrically and thermally because integrated on the same Si substrate 10, so as to output an already amplified signal from the head.

Figure 1:
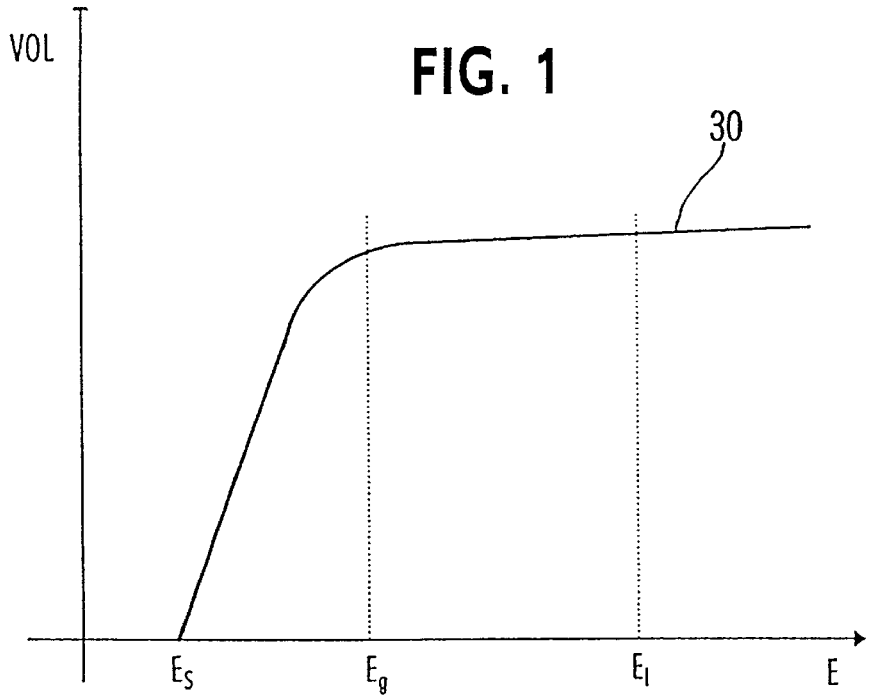
FIG. 1 is a schematic representation of the pattern of the volume of the droplets emitted by a thermal ink jet printhead, in relation to the energy provided to the emission resistors.
Figure 4:
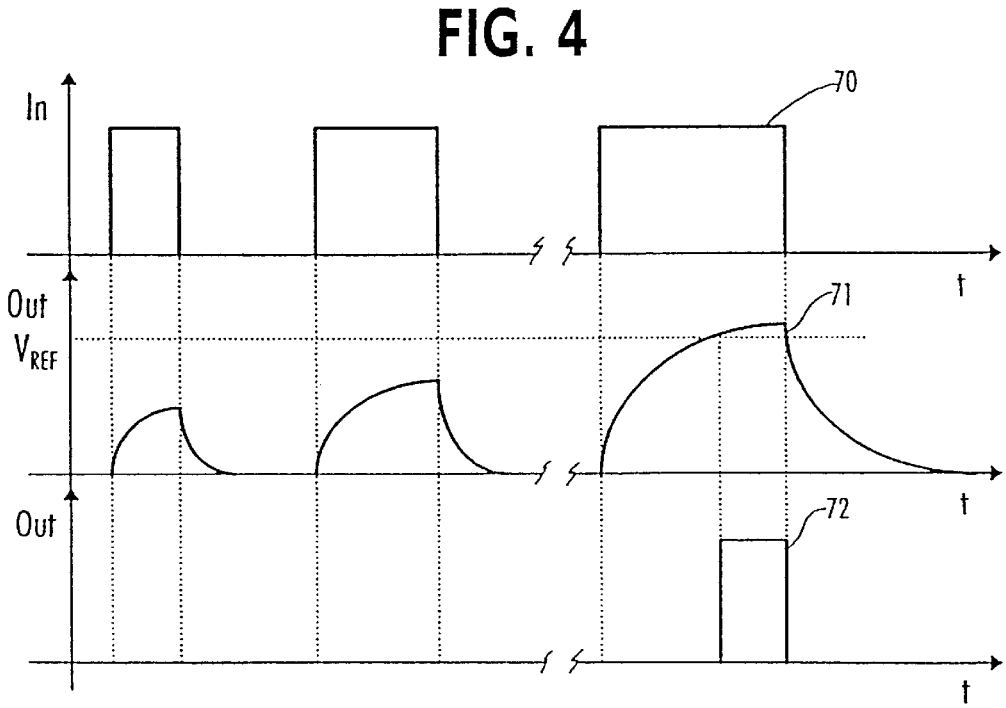
FIG. 4 is a schematic representation of the pattern with respect to time of some electrical quantities of the device for controlling the energy supplied to an emission resistor of a thermal ink jet printhead according to the invention.
Figure 3:
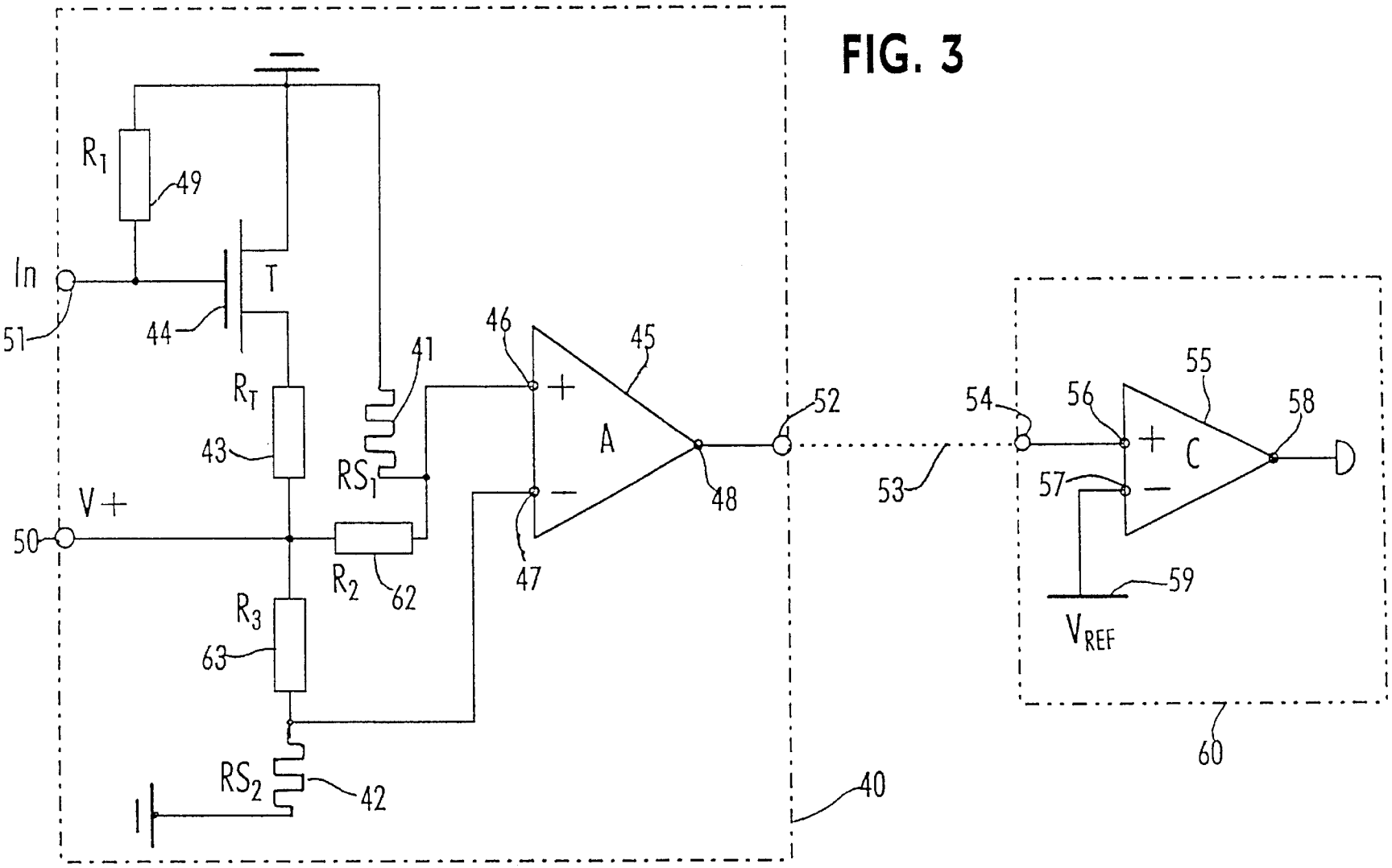
FIG. 3 is a simplified wiring diagram of the device for controlling the energy supplied to an emission resistor of a thermal ink jet printhead according to the invention.

Illustrated in FIG. 3, as a non-exhaustive example, is the wiring diagram of the device according to the invention, comprising a circuit part 40 integrated on the printhead and consisting of a linear feedback differential amplifier A 45, to whose inputs (+) 46 and (−) 47 are respectively connected a first resistive divider formed by a resistor $R_2$62 and by the temperature sensor $RS_1$41, and a second resistive divider formed by a resistor $R_3$63 and by the reference temperature sensor $RS_2$42. The "test" resistor $R_T$43 selectively receives a current pulse by means of the transistor T 44 which amplifies a corresponding pulse $I_n$ on an input 51 of the printhead represented by the curve 70 of FIG. 4. An output 48 of the amplifier A 45, the pattern of which is represented by the curve $O_{ut}$71 of FIG. 4, is connected to an output terminal 52 of the head and, by means of a connection 53 made, for example, using a flat cable, is brought to an input terminal 54 of the electronic controller 60 of the printer and therefrom to an input (+) 56 of an operational amplifier C 55, whose input (−) 57 is connected to a reference voltage $V_{REF}$59, and whose output 58 is represented by a curve 72 in FIG. 4.

Operation of the device will now be described with reference to FIGS. 3 and 4. Through the transistor T 44, the "test" resistor $R_T$43 is supplied with a series of current pulses 70 of steadily increasing duration, for instance 30 successive pulses such that the first one has a time of 1.5 $\mu$s and the subsequent ones have a time progressively increasing by 50 ns up to 3 $\mu$s; the repetition frequency of the series of pulses is determined on the basis of the structure's "thermal memory", since the "test" resistor $R_T$43 must be brought back to the temperature of the substrate 10 between one pulse and the next. One possible repetition frequency is, for example, 1 kHz, enabling the entire range of measurement to be traversed in 30 ms.

With each current pulse 70, there is a change in the resistance of the temperature sensor $RS_1$ which results in a change in the voltage on the input 46 of the differential amplifier A 45; the input 47 however remains constant, since the "test" resistor $R_T$43 and the temperature sensor $RS_1$ are located at a given distance, for example several hundred $\mu$m, from the divider $RS_2/R_3$, perfectly symmetrical to the divider $RS_1/R_2$ being fabricated by integration on the same area of the Si substrate 10, and from the differential amplifier A 45, so as not to have any temperature gradients in the amplifier area which could affect matching and offsetting, generating measurement errors.

The signal 71 is sent from the output of the linear differential amplifier A 45 to the operational amplifier C 55, which effects the comparison with a suitably determined reference voltage $V_{REF}$59 to produce a signal $O_{ut}$72 on the output 58 when the temperature sensor $RS_1$41 detects an established temperature, for example 320° C. (enucleation temperature), in correspondence with a precisely determined duration of the current pulse heating the "test" resistor $R_T$. The printers electronic controller acquires the signal 72 and, where applicable, taking into account specific determined correction factors of the detection system implemented, accordingly determines the correct duration of the pulse to send to the emission resistors of the printhead in order to provide an optimum value for the working energy $E_I$, thereby offsetting the variations both of the head process parameters, and of the printer machine characteristics.

A second embodiment will now be illustrated of the method for controlling the energy supplied to an emission resistor of a thermal ink jet printhead, based on the same device as described previously.

It is well known that the surface temperature of the emission resistors, at the interface with the ink, undergoes a sharp variation in slope at the time of formation of the bubble, due to the fact that the heat is now dissipated not in a liquid environment, but a gaseous one, decreasing by a factor of ~1.6 times. This phenomenon can be made use of with the same device as illustrated in FIG. 3, the only variant being that of using a reference voltage $V_{REF}$59 that is no longer fixed, but variable in the sense that it increases progressively in steps corresponding to the increase in duration of the current pulses 70 supplied to the "test" resistor $R_T$43, according to a law in turn depending on extent of the linearity, greater or lesser, of the temperature detection system. In this way, the variations in amplitude of the output 48 of the differential amplifier A 45, as a result of the increase in duration of the current pulses 70, are compensated for as long as the heat exchange between "test" resistor $R_T$43 and the ink contained in the emission chamber 21 follows the pattern of the exchange with a liquid, and accordingly, the comparator C 55 continues to provide a null output.

When, on the other hand, the duration of the current pulse 70 is such as to provide a working energy $E_I$ sufficient to reach the bubble enucleation temperature, the change in the emission resistor's heat exchange characteristics from liquid to gaseous environment and the resultant increase in amplitude of the output 48 of the differential amplifier 45 is no longer compensated by the corresponding increase in the reference voltage $V_{REF}$59, and therefore the comparator C 55 produces a signal 72 on the output 58, indicating that the bubble enucleation temperature has been reached. The printer's electronic controller, where applicable taking into account specific determined correction factors of the detection system implemented, determines the duration of the pulse to send the emission resistors of the printhead so as to provide an optimum value for the working energy $E_I$, thereby offsetting the variations both of the head manufacturing process parameters and of the printer machine characteristics.

This second embodiment of the method for controlling the energy supplied to an emission resistor of a thermal ink jet printhead, is more precise and direct than the first. Unlike the previous one, however, it requires ink to be in the emission chamber 21 inside which the "test" resistor $R_T$43 is located, so that the latter and the associated temperature sensor $RS_1$41 must be located in the vicinity of the ink feeding slot.

Naturally changes may be made to the invention described above, without exiting from the scope thereof.

For example, a "test" resistor $R_T$43 may be used with dimensions different from those of the emission resistors. In this case, account will naturally have to be taken of a shape or area correction factor $K_1$ to correlate the value of the energy needed to bring the "test" resistor $R_T$43 to the bubble enucleation temperature with that of the energy needed to bring the emission resistors 15 to the same temperature, with account also being taken of the ratio of the area of the temperature sensor $RS_1$41 to the area of the "test" resistor $R_T$43 since the surface temperature of the temperature sensor $RS_1$41 is not homogeneous, but varies from the centre to the periphery.

Use is also possible, though only if the first embodiment of the device for controlling the energy supplied to an emission resistor of a thermal ink jet printhead is adopted, of an emission chamber 21 around the "test" resistor $R_T$43 without any ink in which case, account will have to be taken of an environmental correction factor $K_2$ since, for like values of the energy supplied to the "test" resistor $R_T$43, the surface temperature measured by the temperature sensor $RS_1$41 will be approximately 1.6 times greater than the corresponding temperature reached by an emission resistor in contact with the ink.

It is also possible to vary the energy supplied to the emission resistors, by acting not on the duration of the current pulses, but on the value of the voltage V+50 (FIG. 3) which is the shared reference of all the resistors, leaving pulse duration unchanged. In this case, it will naturally be necessary to have two separate voltage supplies: one voltage supply to supply the variable voltage that all the resistors are referred to, and a second voltage supply to supply voltage to the integrated electronic circuits of the head, which has to be kept constant.

What is claimed is:

1. A device for controlling an energy supplied to an integrated emission resistor of a thermal ink jet print head fitted on a printer, said emission resistor being arranged on a substrate and being capable of generating a vapour bubble upon reaching an enucleation temperature, said printer comprising means for selectively supplying an amount of said energy to said emission resistor, said print head comprising a protective layer arranged on said emission resistor, a layer of Ta arranged on said protective layer and a layer of electrically conductive material arranged on said layer of Ta, for making connections to said emission resistor, wherein the improvement comprises:

a temperature sensor formed from said layer of electrically conductive material;

a reference temperature sensor arranged on said substrate, at a determined distance from said temperature sensor;

said temperature sensor and reference temperature sensor being provided for detecting said enucleation temperature and being arranged in correspondence with an integrated test resistor of said print head, identical in construction to said emission resistor.

2. A device according to claim 1, wherein said electrically conductive material is Gold deposited on Tantalum layer.

3. A device according to claim 2, characterized in that said layer of Gold is between 2000 and 4000 Å thick.

4. A device according to claim 2, wherein said temperature sensor obtained from said layer of Gold is zig-zag shape, of between 2 and 10 $\mu$m wide.

5. A device according to claim 4, wherein said temperature sensor has a resistance of between 3 and 6 Ohm.

6. A device according to claim 5, characterized in that said means for supplying said amount of said energy to said emission resistor (15) comprise:

means for supplying said energy in the form of current pulses of constant intensity and variable duration;

means for effecting a regulation of said variable duration from a minimum duration to a maximum duration, said, regulation being dependent on said means (41, 42) for detecting said enucleation temperature.

7. A device according to claim 6, characterized in that said minimum duration is of 1.5 $\mu$s and said maximum duration is of 3 $\mu$s.

8. A device according to claim 6, wherein said means for effecting said regulation of said duration comprise a differential amplifier having a first input connected to said temperature sensor, and a second input connected to said reference temperature sensor.

9. A device according to claim 8, characterized in that said means (40, 60) for effecting said regulation of said duration further comprise a comparator (55) having a first input (56) connected to an output (52) of said differential amplifier (45), and a second input (57) connected to a reference voltage (59).

10. A device according to claim 1, wherein said means for arranged inside an emission chamber containing ink.

11. A device according to claim 1, wherein said test resistor is arranged inside an emission chamber containing air.

12. A device according to claim 1, wherein said means for selectively supplying said amount of said energy to said emission resistor comprise:

means for supplying said energy in the form of current pulses of constant duration and variable intensity;

means for effecting a regulation of said variable intensity from a minimum intensity to a maximum intensity, said regulation being dependent on said means for detecting said enucleation temperature.

* * * * *